US007347721B2

(12) United States Patent
Kameyama

(10) Patent No.: US 7,347,721 B2
(45) Date of Patent: Mar. 25, 2008

(54) CONNECTOR

(75) Inventor: Isao Kameyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/522,349

(22) Filed: Sep. 18, 2006

(65) Prior Publication Data

US 2007/0099486 A1 May 3, 2007

(30) Foreign Application Priority Data

Oct. 27, 2005 (JP) ..... 2005-312941

(51) Int. Cl.
*H01R 12/24* (2006.01)

(52) U.S. Cl. ..... 439/498

(58) Field of Classification Search ..... 439/701, 439/498, 79, 660, 598–599, 686, 607–610, 439/497, 892, 752; 333/32–35
See application file for complete search history.

(56) References Cited

U.S. PATENT DOCUMENTS 4,964,814 A * 10/1990 Tengler et al. ..... 439/607
6,602,094 B1 * 8/2003 Wang ..... 439/598
6,808,417 B2 * 10/2004 Yoshida ..... 439/585
6,939,174 B2 * 9/2005 Wu ..... 439/608
2004/0190986 A1 * 9/2004 Hara et al. ..... 403/329
2005/0101166 A1 * 5/2005 Kameyama ..... 439/79

FOREIGN PATENT DOCUMENTS

JP 2003-100399 A 4/2003
JP 2004-327419 A 11/2004
JP 2005-149789 A 6/2005

* cited by examiner

*Primary Examiner*—Edwin A. Leon
(74) *Attorney, Agent, or Firm*—Sughrue Mion, PLLC

(57) ABSTRACT

A connector includes a connector housing having a plurality of terminal receiving chambers arranged in a row, and a plurality of terminals which are connected respectively to end portions of a plurality of wires of a cable, and are received respectively in the terminal receiving chambers. Wall reduction portions are formed respectively in partition walls of the connector housing, each interposed between the adjacent terminal receiving chambers, so that an impedance of the connector can be matched with an impedance of the cable.

6 Claims, 10 Drawing Sheets

CONNECTOR

BACKGROUND OF THE INVENTION

1. Field of the Invention

This invention relates to a connector secured, for example, to a cable installed in a vehicle such as an automobile.

2. Related Art

Various electronic equipments such for example as a navigation system are mounted on a vehicle such as an automobile. Cables each comprising a plurality of wires are installed in the vehicle so as to supply electric power to these electronic equipments and also to transmit signals between the electronic equipments. A connector for connection to a connector of the electronic equipment is secured to the cable.

For example, the above navigation system comprises a body portion for calculating a present position of the vehicle, and a display for indicating the present position of the vehicle and the position of a destination, and the body portion and the display are connected together via a cable. In recent years, the display has been required to have high resolution, and also has been required to display the present position of the vehicle in real time, and therefore it has become necessary to transmit a large amount of signals between the body portion and the display at high speed.

There are two types of conventional high-speed transmission methods, that is, an unbalanced (single-end) type and a differential type. In the unbalanced type, one signal wire is used for each signal path, and a grounding wire is common to the signal paths, and a voltage of each signal wire relative to the grounding potential is transmitted as a signal. On the other hand, in the differential type, two signal wires are used for each signal path, and a voltage difference between the two wires is transmitted as a signal. In the differential type, voltages of the two wires are equal in magnitude to each other, and are 180° out of phase with each other, and the differential type does not respond to a signal (such electromagnetic noises) evenly applied to the two signal wires, and therefore the differential type has a feature that it is resistant to noises, and therefore is suited for high-speed transmission.

The Applicant of the present application has earlier proposed a connector used for such differential type transmission, which connector includes a plus signal terminal and a minus signal terminal for connection respectively to two wires (For convenience' sake, one is for a plus signal, and the other is for a minus signal) of a cable, and a ground terminal for connection to a grounding wire of the cable (see, for example, JP-A-2003-100399).

The cable to which the connector of JP-A-2003-100399 Publication is secured includes the plus signal wire, the minus signal wire, and the grounding wire. The plus signal wire, the minus signal wire and the grounding wire are arranged parallel to one another, and are disposed in a triangle pattern (that is, disposed respectively at apexes of a triangle) in a transverse cross-section of the cable perpendicular to a longitudinal axis of the cable.

Here, impedance match is achieved between the cable, the connector of the cable, and the connector of the electronic equipment. If impedance mismatch is encountered, reflection of the signal occurs at such a mismatching region, so that the proper transmission can not be effected. Particularly when transmitting a large amount of signals at high speed, the impedance need to be strictly matched.

Therefore, in the connector disclosed in JP-A-2003-100399, the plus signal terminal, the minus signal terminal and the ground terminal are arranged in a triangular pattern (that is, disposed respectively at apexes of a triangle) as is the case with the arrangement of the wires of the cable to which these terminals are connected. With this arrangement, the relative positional relation of the signal path (that is, the wires and the terminals connected to the respective wires) is generally constant over the entire range including the cable and the connector, and therefore impedance match between the connector and the cable is enhanced.

In recent years, connectors have been required to have a compact or small-size design, and in order to meet this requirement a gap between adjacent terminals tends to be reduced. It is known that the gap between the adjacent terminals, a dielectric constant of an insulator (that is, a synthetic resin forming a connector housing) disposed between the terminals, etc., are related to the impedance of the connector.

In this respect, in a connector of a conventional structure such as the connector of JP-A-2003-100399 Publication, the impedance can be matched by suitably changing a connector housing-forming synthetic resin. Namely, a synthetic resin of a lower dielectric contact is used as the synthetic resin for forming the connector housing, and by doing so the impedance match which is lowered by the reduced gap between the terminals due to the compact design of the connector can be maintained at a conventional level. Among various synthetic resins, for example, teflon has an extremely low dielectric constant, and is suitable for forming the connector housing.

However, when a different synthetic resin is used for each connector, it is feared that the production cost of the connector increases. Furthermore, when connectors become increasingly compact in design, it is thought that it is difficult to obtain impedance match even with the use of teflon, and besides teflon is relatively expensive.

Soldering is often used as joining means for electrically connecting a terminal to a wire. In this case, the synthetic resin, forming the connector housing, is required to have heat resistance. There is known the type of synthetic resin having glass fibers or the like mixed therein in order to enhance the heat resistance. However, usually, the dielectric constant tends to be increased by such additive. Therefore, even when the connector housing-forming synthetic resin is suitably changed, this synthetic resin is limited to a special one having excellent heat resistance and a low dielectric constant.

SUMMARY OF THE INVENTION

This invention has been made in view of the above circumstances, and an object of the invention is to provide a connector in which the impedance of the connector can be easily matched with the impedance of a cable without depending on a synthetic resin for forming a connector housing.

The above object has been achieved by a connector recited in the following Paragraphs (1) to (5).

(1) A connector comprising a connector housing having a plurality of terminal receiving chambers arranged in a row, and a plurality of terminals which are connected respectively to end portions of a plurality of wires of a cable, and are received respectively in the terminal receiving chambers; characterized in that:

wall reduction portions are formed respectively in partition walls of the connector housing, each interposed between the adjacent terminal receiving chambers, so that an impedance of the connector can be matched with an impedance of the cable.

(2) The connector of the above Paragraph (1) is further characterized in that the wall reduction portions extend respectively through the partition walls in a direction of juxtaposition of the terminal receiving chambers, and are aligned with one anther in the direction of juxtaposition of the terminal receiving chambers.

(3) The connector of the above Paragraph (1) is further characterized in that each of the wall reduction portions is in the form of a recess, and the wall reduction portions are formed in side surfaces of the partition walls, respectively.

(4) The connector of the above Paragraph (3) is further characterized in that each of the terminal receiving chambers has a generally rectangular cross-section; and each of the partition walls has the wall reduction portions formed respectively in opposite side surfaces thereof, and the wall reduction portions, formed respectively in the side surfaces of any two adjacent partition walls opposed to each other with the terminal receiving chamber interposed therebetween, are disposed generally diagonally with respect to the terminal receiving chamber.

(5) The connector of any one of the above Paragraphs (1) to (4) is further characterized in that the connector is a differential transmission connector.

In the connector of the construction of the above Paragraph (1), the wall reduction portions are formed respectively in the partition walls of the connector housing each disposed between the corresponding adjacent terminal receiving chambers. Therefore, an air gap is formed between any two adjacent terminals received in the respective terminal receiving chambers. The dielectric constant (about 1.0) of the air is lower than the dielectric constant (about 2.25) of teflon. Therefore, in the connector of this construction, even when the gap between any two adjacent terminals is reduced because of a compact design of the connector, the impedance of the connector can be matched with the impedance of the cable without depending on a material for forming the connector housing, and for example, a material with a relatively high dielectric constant and excellent moldability and heat resistance or any one of various commonly-used materials can be used for forming the connector housing. Furthermore, in the connector of this construction, by suitably adjusting the configuration and disposition of the wall reduction portions, only impedance mismatch portions of the connector can be adjusted, and by thus adjusting the impedance of part of the connector housing, the wall thickness of the relevant portions of the connector housing can be reduced, which contributes to the compact design of the connector.

In the connector of the construction of the above Paragraph (2), the wall reduction portions are formed respectively through the partition walls in the direction of juxtaposition of the terminal receiving chambers, and are aligned with one another in the direction of juxtaposition of the terminal receiving chambers. Therefore, these wall reduction portions can be easily formed, for example, by forming a transverse hole extending through the connector housing in the direction of juxtaposition of the terminal receiving chambers, and besides the configuration and disposition of these wall reduction portions can be easily adjusted.

In the connector of the above Paragraph (3), these wall reduction portions are formed respectively in the side surfaces of the partition walls, and extend from rear ends of the respective partition walls to front ends thereof in a direction of inserting of each terminal into the terminal receiving chamber. Therefore, the terminal receiving chambers are completely isolated from one another, and there is no risk of short-circuiting between the adjacent terminals.

In the connector of the construction of the above Paragraph (4), the wall reduction portions are disposed generally diagonally in each terminal receiving chamber having the rectangular cross-section, and each terminal 11, inserted and fitted in the corresponding terminal receiving chamber, is held by diagonally-disposed surface portions of the terminal receiving chamber where the wall reduction portions are not formed. Therefore, in the connector of this construction, the wall reduction portions of a larger size can be formed in the respective partition walls while ensuring that the terminals can be positively held against shaking, and even with a smaller design of the connector, the impedance of the connector can be matched with the impedance of the cable.

The connector of the construction of any one of the above Paragraphs (1) to (4) is suitably used as a differential transmission connector for transmitting a large amount of signals at high speed.

In the present invention, there can be provided the connector in which the impedance of the connector can be easily matched with the impedance of the cable without depending on the synthetic resin for forming the connector housing.

DETAILED DESCRIPTION OF THE PREFERRED EMBODIMENTS

Preferred embodiments of the present invention will now be described in detail with reference to the drawings.

First Embodiment

Figure 1:
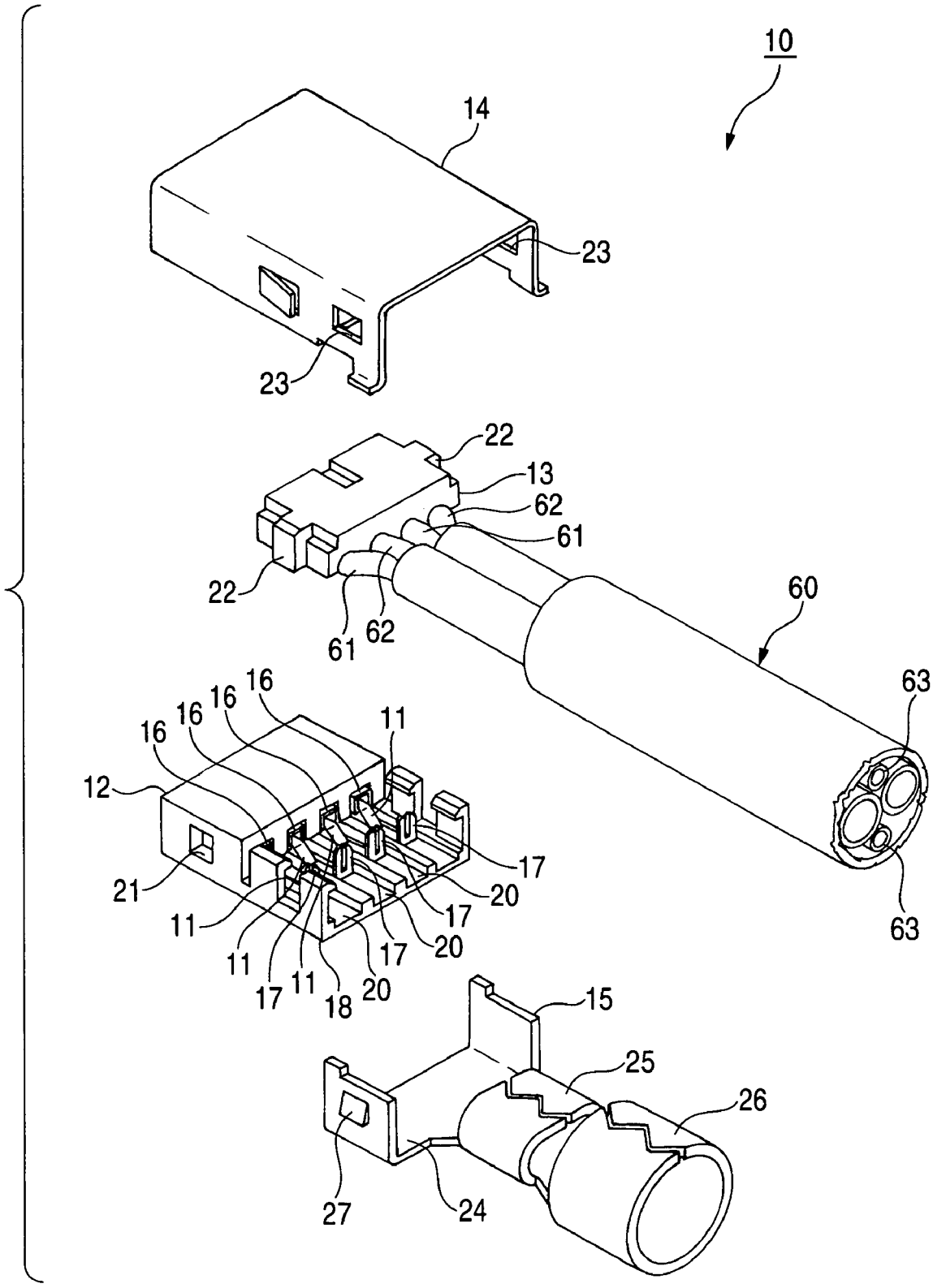
FIG. 1 is an exploded, perspective view of a first embodiment of a connector of the present invention.
Figure 2:
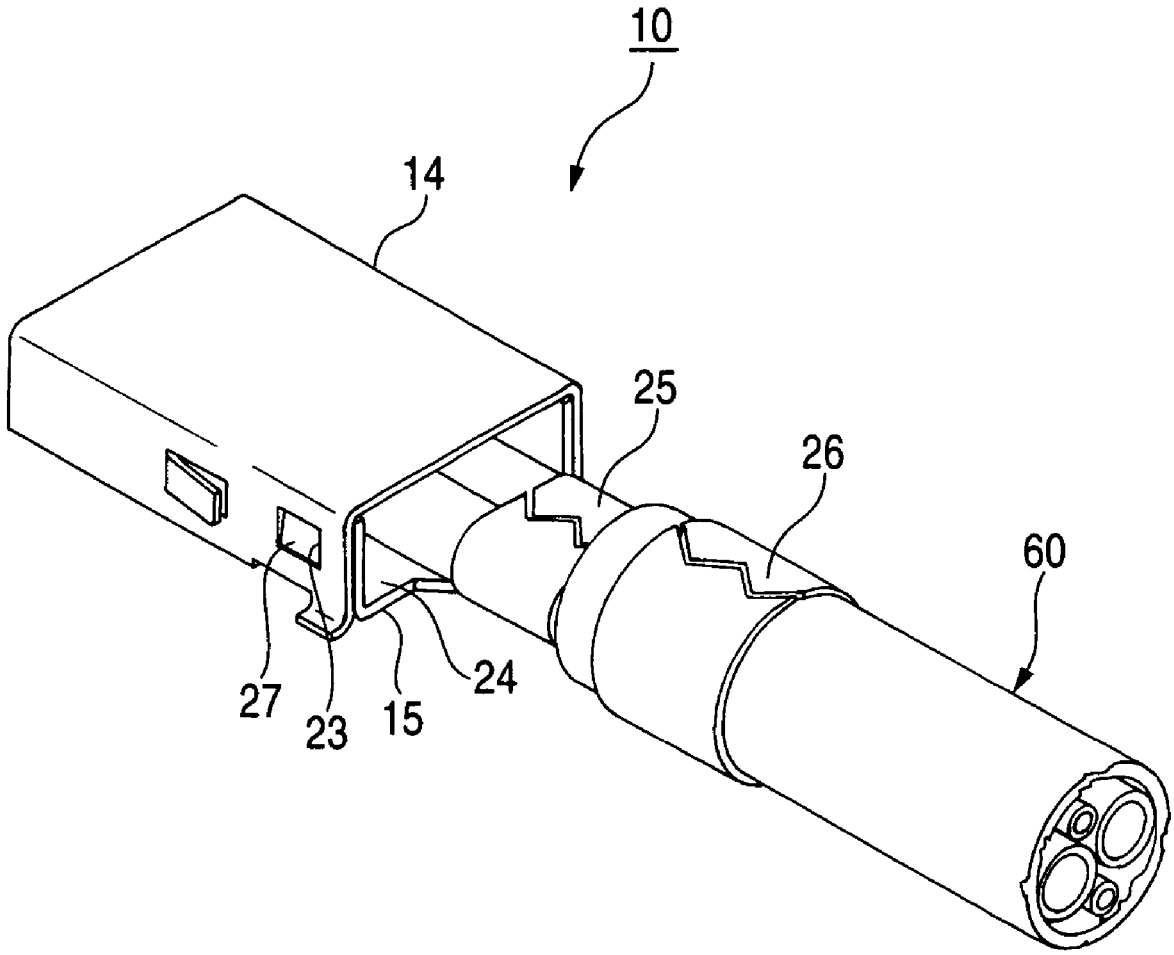
FIG. 2 is a perspective view showing the connector of FIG. 1 in its assembled condition.
Figure 3:
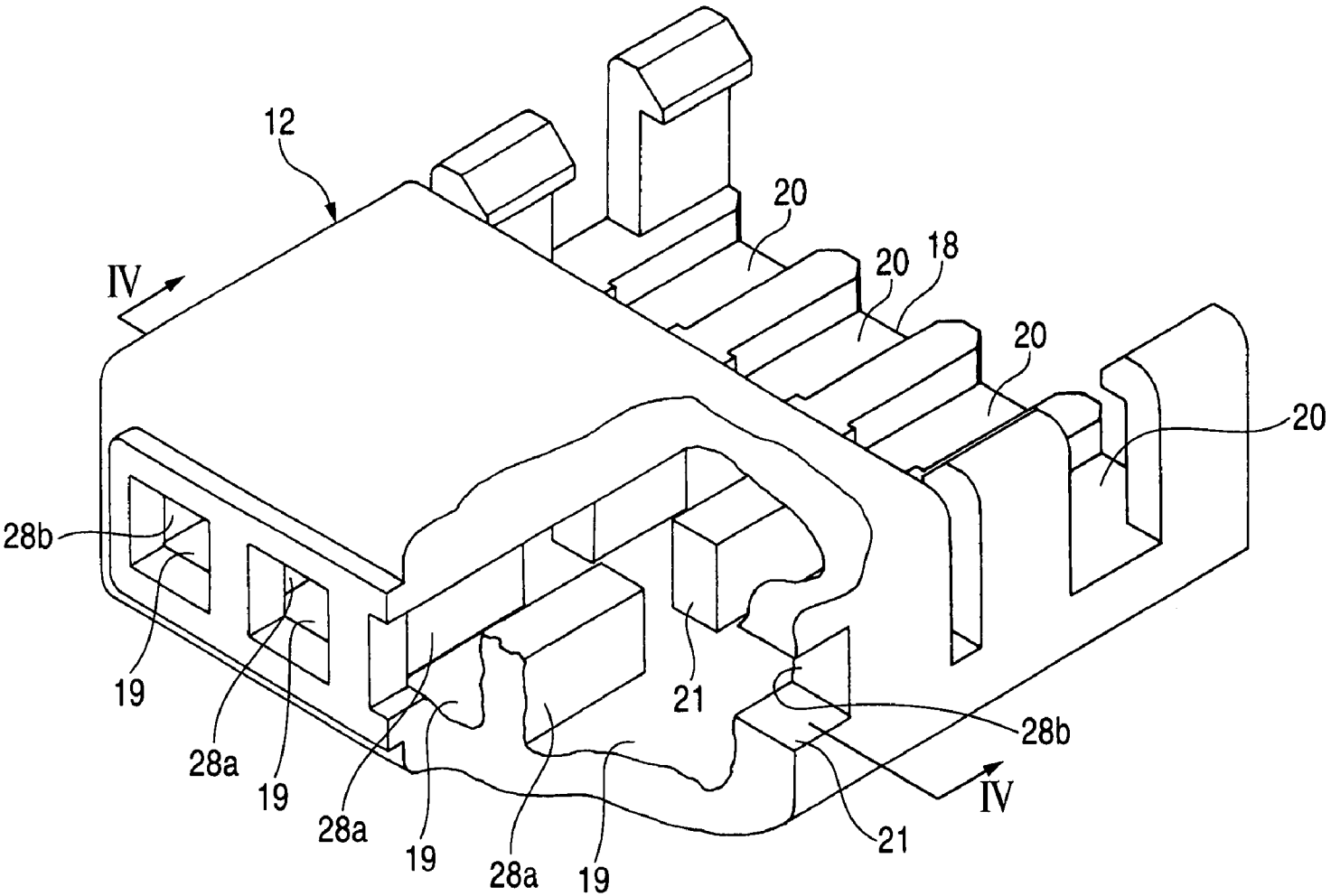
FIG. 3 is a partially-broken, perspective view of a connector housing of the connector of FIG. 1.
Figure 4:
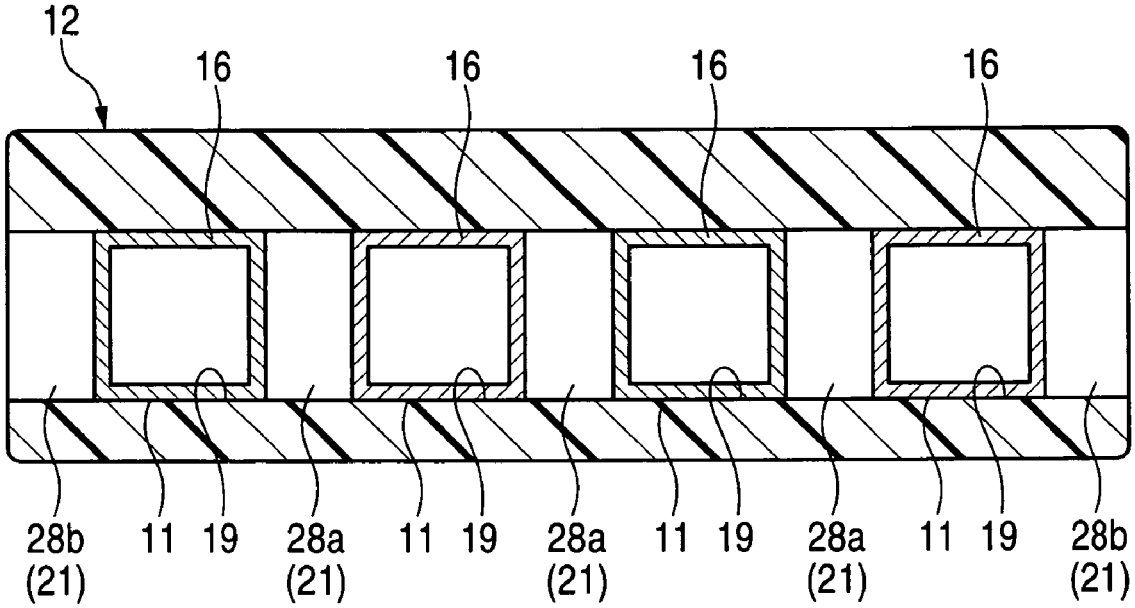
FIG. 4 is a cross-sectional view of the connector housing taken along the line IV-IV of FIG. 3.

FIG. 1 is an exploded, perspective view of a first embodiment of a connector of the invention, FIG. 2 is a perspective view showing the connector of FIG. 1 in its assembled condition, FIG. 3 is a partially-broken, perspective view of a connector housing of the connector of FIG. 1, and FIG. 4 is a cross-sectional view of the connector housing taken along the line IV-IV of FIG. 3.

As shown in FIGS. 1 and 2, the connector 10 of this embodiment is used in the above-mentioned differential-type transmission, and is secured to a distal end of a cable 60. In the following description, the direction of connecting of the connector 10 to a mating connector attached to an electronic equipment or the like will be defined as "forward direction".

The cable 60 has two signal paths each including two signal wires 61 and 62, and a grounding wire 63. Voltages of the two signal wires 61 and 62 are equal in magnitude to each other, and are 180° out of phase with each other, and a voltage difference between the two signal wires 61 and 62 is transmitted as a signal.

The connector 10 comprises a wire holding member 13 for holding distal end portions of the two pairs of signal wires 61 and 62 of the two signal paths such that these distal end portions are arranged or juxtaposed in a row, four terminals 11 for being connected respectively to the distal end portions of the two pairs of signal wires 61 and 62 of the two signal paths, and the connector housing 12 having terminal receiving chambers 19 in which the respective terminals 11 are inserted and received, a shielding shell 14 provided to surround the outer periphery of the connector housing 12, and a shell cover 15 for electrically connecting the shielding shell 14 to the grounding wires 63 of the two signal paths of the cable 60.

Each terminal 11 is a so-called press-contacting terminal, and includes a tubular electrical connection portion 16 formed at a front end portion thereof so as to be electrically connected to a terminal of the mating connector, and a pair of press-contacting blades 17 which are formed at a rear end portion thereof, and define a slot therebetween into which the signal wire 61, 62 is press-fitted. When the signal wire 61, 62 is press-fitted into the slot between the pair of press-contacting blades 17, these blades 17 cut an insulating sheath of the signal wire 61, 62, and hold an internal conductor of this signal wire therebetween, thereby achieving electrical connection between the terminal 11 and the signal wire 61, 62.

The connector housing 12 is injection molded of a general-purpose synthetic resin with relatively excellent heat resistance and moldability (rigidity) such for example as PBT (polybutylene terephthalate) or PPS (polyphenyl sulfide). The terminal receiving chambers 19 for respectively receiving the electrical contact portions 16 of the terminals 11 are formed in a front end portion of the connector housing 12, and are arranged or juxtaposed at predetermined intervals in a row. A wire holding member-mounting portion 18 for the mounting of the wire holding member 13 (described later) therein is formed at a rear end portion of the connector housing 12.

The wire holding member-mounting portion 18 is open upwardly and rearwardly, and four receiving grooves 20 for respectively receiving the exposed rear end portions of the four terminals 11 extending outwardly from the respective terminal receiving chambers 19 are formed in a bottom plate portion of this wire holding member-mounting portion 18. The rear end portions of the four terminals 11 are received in the four receiving grooves 20, respectively, and are arranged in a row at predetermined intervals. The pair of press-contacting blades 17, formed at the rear end portion of each terminal 11, are disposed such that their distal ends are directed upwardly (In other words, an open end of the slot therebetween is directed upwardly).

The wire holding member 13 is made of a synthetic resin similar to the synthetic resin of which the connector housing 12 is made, and this wire holding member 13 holds the distal end portions of the two pairs of signal wires 61 and 62 of the two signal paths of the cable 50 such that these distal end portions are arranged in a row. Grooves are formed in a bottom surface of the wire holding member 13 to reach the four signal wires 61 and 62, and the pair of press-contacting blades 17 of each terminal 11 are inserted into a respective one of these grooves. This wire holding member 13 is attached to the wire holding member-mounting portion 18 from the upper side thereof, and at this time the pair of press-contacting blades 17 of each terminal 11 are inserted into the corresponding groove, so that the four terminals 11 are electrically connected to the four signal wires 61 and 62, respectively. When the wire holding member 13 is mounted in the wire holding member-mounting portion 18, engagement portions 22 formed respectively at opposite side surfaces of the wire holding member 13, are retainingly engaged respectively with retaining claws formed respectively at opposite side portions of the wire holding member-mounting portion 18.

The shielding shell 14 is made of an electrically-conductive material, and is formed into a generally rectangular tubular shape. The connector housing 12, having the wire holding member 13 mounted thereon, is inserted and fitted into the interior of the shielding shell 14, so that this shielding shell 14 surrounds the outer periphery of the connector housing 12. A pair of engagement holes 23 for the purpose of mounting the shell cover 15 (described later) are formed respectively through opposite side walls of the shielding shell 14 at a rear end portion thereof.

The shell cover 15 is made of an electrically-conductive material similar to the electrically-conductive material of which the shielding shell 14 is made, and this shell cover 15 includes a mounting portion 24 of a generally U-shaped cross-section which is formed at a front end portion thereof, and is attached to the rear end portion of the shielding shell 14, the mounting portion 24 having a pair of retaining projections 27 for being engaged respectively in the pair of engagement holes 23 in the shielding shell 14. A grasping portion 25 for being pressed to firmly hold or grasp the four signal wires 61 and 62 and the two grounding wires 63 of the two signal paths of the cable 60 together is formed at a rear end portion of the shell cover 15. Further, a grasp portion 26 for being pressed to firmly grasp a sheath of the cable 60 is formed at the rear end portion of the shell cover 15, and is disposed rearwardly of the grasp portion 25. A distal end portion of each of the grounding wires 63 which is to be grasped by the grasp portion 25 of the shell cover 15 is stripped of a sheath, so that an internal conductor thereof is exposed at this distal end portion. Therefore, the shielding shell 14, the shell cover 15, and the two grounding wires 63 of the two signal paths are electrically connected together to form a grounding circuit in the connector 10.

Referring to FIGS. 3 and 4, a transverse hole is formed in the front end portion of the connector housing 12, and extends through this front end portion in the direction of juxtaposition of the four terminal receiving chambers 19. As a result, wall reduction portions 21 are formed respectively through partition walls 28*a* (each interposed between the adjacent terminal receiving chambers 19) and opposite side walls 28*b* of the connector housing 12 (which respectively define outer side walls of the two terminal receiving chambers 19 disposed respectively at the opposite side portions of the connector housing 12 spaced from each other in the direction of juxtaposition of the terminal receiving chambers 19) in the direction of juxtaposition of the terminal receiving chambers 19, and are aligned with one another in the direction of juxtaposition of the terminal receiving chambers 19 so that the impedance of the connector 10 can be matched with the impedance of the cable 60.

The transverse hole, extending through the front end portion of the connector housing 12, can be formed during the injection molding of the connector housing 12, for example, by the use of a die which is set in a mold for injection molding the connector housing 12. Alternatively, after the connector housing 12 is injection molded, the transverse hole can be formed using a suitable cutting tool. In either case, the transverse hole can be easily formed.

Here, the wall reduction portions 21 are formed also through the opposite side walls 28*b*. However, particularly when the gap between the adjacent terminals 11 is small, the impedance of the connector 10 is predominantly determined by the gap between the adjacent terminals and the dielectric constant of the partition walls 28*a* each interposed between the adjacent terminals 11, as described above, and therefore the wall reduction portions 21 in the respective side walls 28*b* will not substantially affect the impedance of the connector 10. Furthermore, the outer periphery of the connector housing 12 is surrounded by the shielding shell 14, and therefore foreign matters will not intrude into the connector housing 12 through the wall reduction portions 21 in the respective side walls 28*b*.

Furthermore, in the connector 10 of this embodiment, the wall reduction portions 21 are formed through the respective partition walls 28*a*, and therefore the adjacent terminals 11 are not completely isolated from each other. However, short-circuiting between the adjacent terminals 11 can well be prevented by taking care that foreign matters do not intrude into the wall reduction portions 21 in the respective partition walls 28*a* during the assembling operation.

As described above, in the connector 10 of this embodiment, the wall reduction portions 21 are formed respectively through the partition walls 28*a* of the connector housing 12 each disposed between the corresponding adjacent terminal receiving chambers 19. Therefore, an air gap is formed between any two adjacent terminals 11 received in the respective terminal receiving chambers 19. The dielectric constant (about 1.0) of the air is lower than the dielectric constant (about 2.25) of teflon. Therefore, in the connector 10 of this embodiment, even when the gap between any two adjacent terminals is reduced because of the compact design of the connector 10, the impedance of the connector 10 can be increased to be matched with the impedance of the cable 60 without depending on the material forming the connector housing 12, and for example, a material with a relatively high dielectric constant and excellent moldability and heat resistance or any one of various commonly-used materials can be used for forming the connector housing 12. Furthermore, in the connector 10 of this embodiment, by suitably adjusting the configuration and disposition of the wall reduction portions 21, only impedance mismatch portions of the connector 10 can be adjusted, and by thus adjusting the impedance of part of the connector housing 12, the wall thickness of the relevant portions of the connector housing 12 can be reduced, which contributes to the compact design of the connector.

Furthermore, in the connector 10 of this embodiment, the wall reduction portions 21 are formed respectively through the partition walls 28*a* in the direction of juxtaposition of the terminal receiving chambers 19, and are aligned with one another) in the direction of juxtaposition of the terminal receiving chambers 19. Therefore, these wall reduction portions 21 can be easily formed by forming the transverse hole extending through the connector housing 12 in the direction of juxtaposition of the terminal receiving chambers 19, and besides the configuration and disposition of the wall reduction portions 21 can be easily adjusted.

In the connector 10 of this embodiment, although each of the terminal receiving chambers 19 has the rectangular cross-section corresponding to the cross-section of the tubular electrical connection portion 16 of the terminal 11, the invention is not limited to such construction. For example, the electrical connection portion 16 of each terminal 11 can have a cylindrical tubular shape, in which case each terminal receiving chamber 19 can have a round cross-section.

Second Embodiment

Figure 5:
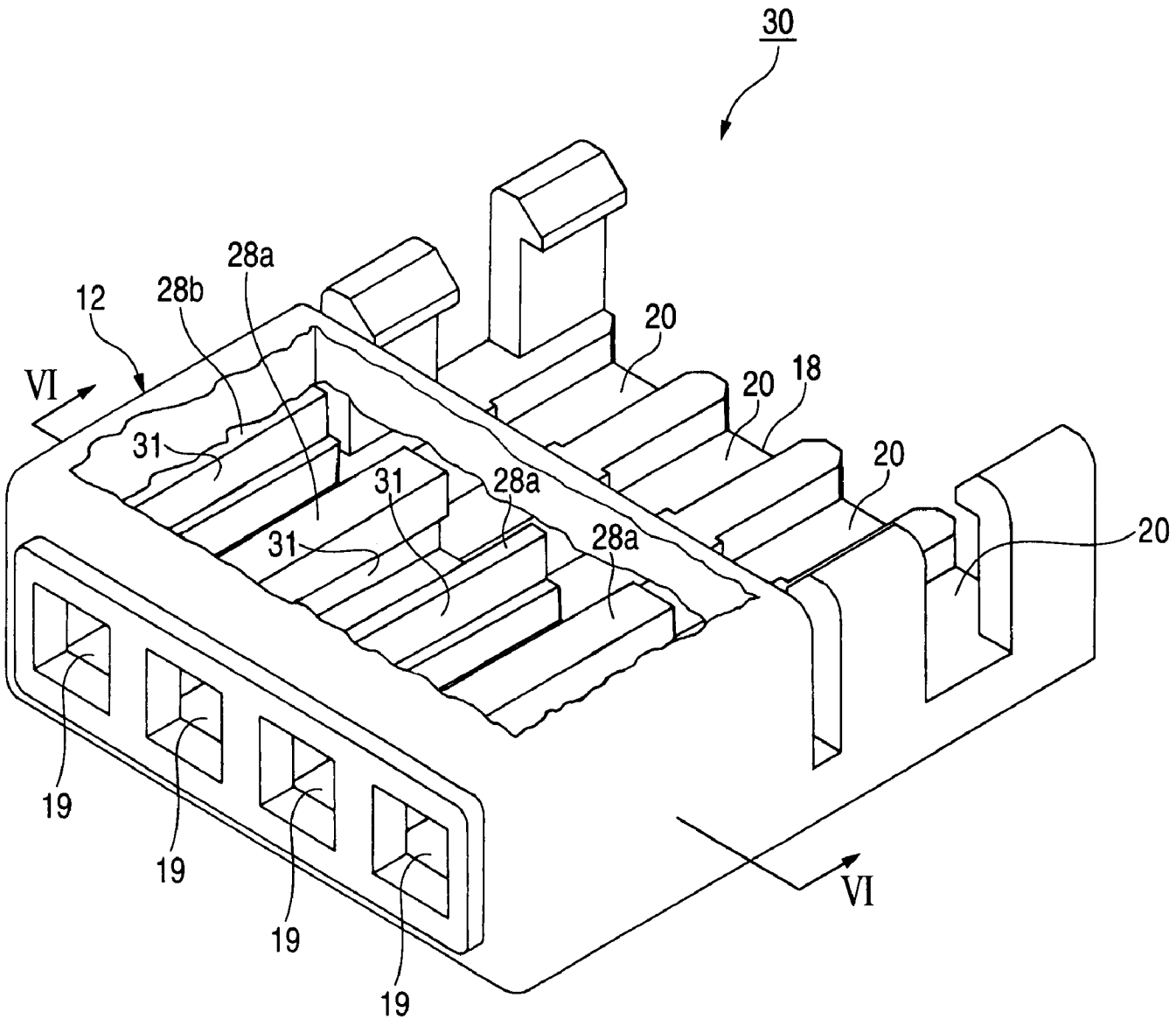
FIG. 5 is a partially-broken, perspective view of a connector housing used in a second embodiment of a connector of the invention.
Figure 6:
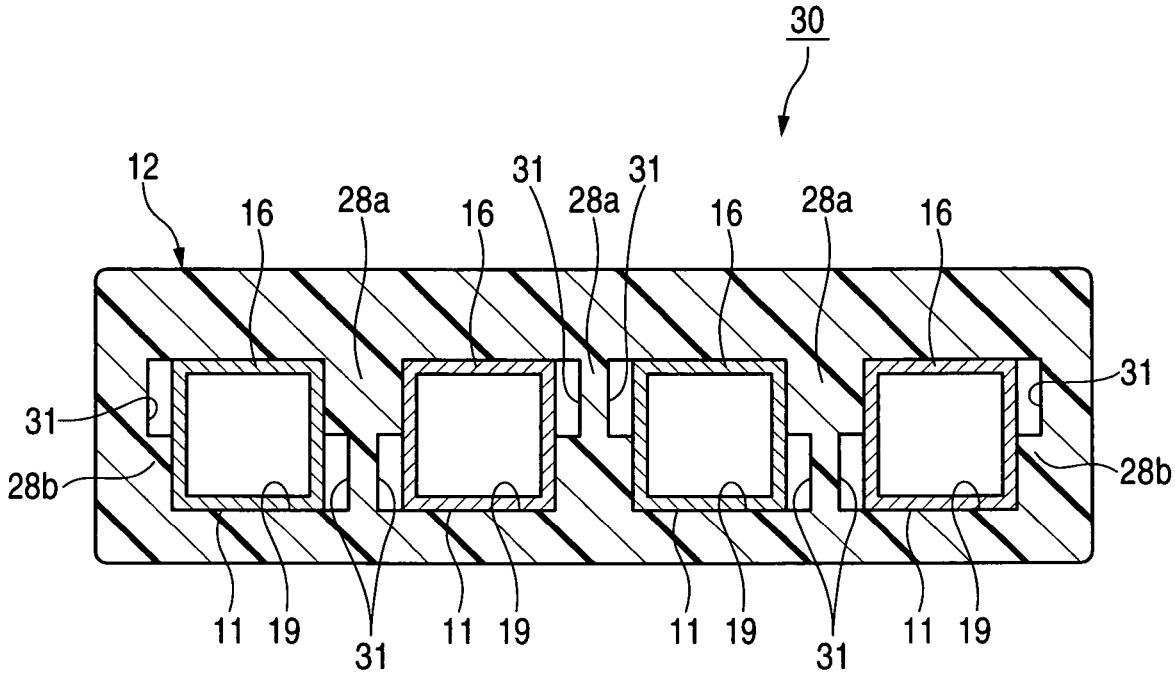
FIG. 6 is a cross-sectional view of the connector housing taken along the line VI-VI of FIG. 5.

Next, a second embodiment of a connector of the invention will be described with reference to FIGS. 5 and 6. FIG. 5 is a partially-broken perspective view of a connector housing used in the connector of the second embodiment, and FIG. 6 is a cross-sectional view of the connector housing taken along the line VI-VI of FIG. 5.

The connector of this embodiment differs from the above-mentioned connector 10 of the first embodiment only in a front end portion of a connector housing 12 having terminal receiving chambers 19, and therefore any figure, showing the overall construction of the connector of this embodiment, is not provided here, and those constituent elements identical or similar in function to those of the above connector 10 will be designated by identical or like reference numerals, respectively, and explanation thereof will be simplified or omitted.

As shown in FIG. 5, in the connector 30 of this embodiment, instead of the wall reduction portions 21 formed through the respective partition walls 28*a* and side walls 28*b* of the connector housing 12 of the connector 10 of the first embodiment, wall reduction portions 31 each in the form of a recess are formed respectively in opposite side surfaces of partition walls 28*a* of the connector housing 12 and inner surfaces of opposite side walls 28*b* of the connector housing 12, and extend from rear ends of the respective partition walls 28*a* and side walls 28*b* to front ends thereof in a direction of inserting of each terminal 11 into the terminal receiving chamber 19. With this construction, the impedance of the connector 30 is matched with the impedance of the cable 60. In the connector 30 of this embodiment, although the wall reduction portions 31 are formed respectively in the opposite side surfaces of the partition walls 28*a* and the inner surfaces of the opposite side walls 28*b*, and extend from the rear ends of the respective partition walls 28*a* and side walls 28*b* to the front ends thereof in the direction of inserting of each terminal 11 into the terminal receiving chamber 19, it is sufficient to form the wall reduction portion 31 (in the form of the recess) at least in part of each of the partition walls 28*a*.

The wall reduction portions 31 can be formed during the injection molding of the connector housing 12, for example, by projecting portions formed on a mold portion (of a mold for injection molding the connector housing 12) for forming the terminal receiving chambers. Alternatively, after the connector housing 12 is injection molded, each wall reduction portion 31 can be formed by inserting a suitable cutting tool into the terminal receiving chamber 19 through an insertion port thereof through which the terminal 11 is inserted into the terminal receiving chamber 19. In either case, the wall reduction portions 31 can be easily formed.

These wall reduction portions 31 do not extend through the respective partition walls 28*a* and side walls 28*b* of the connector housing 12, and therefore the terminal receiving chambers 19 are completely isolated from one another, and short-circuiting between the adjacent terminals 11 is prevented without the need for taking any particular care. And besides, foreign matters will not intrude into the connector housing 12 from the exterior.

Furthermore, in the connector 30 of this embodiment, each of the terminal receiving chambers 19 has a rectangular cross-section, and the wall reduction portions 31 are formed alternately in upper half portions and lower half portions of the partition walls 28*a* and side walls 28*b* in the direction of juxtaposition of the terminal receiving chambers 19. With this arrangement, the wall reduction portions 31 formed respectively in the side surfaces of any two adjacent partition walls 28*a* opposed to each other with the terminal receiving chamber 19 interposed therebetween, as well as the wall reduction portions 31 formed respectively in the inner surface of each side wall 28*b* and the side surface of the corresponding partition wall 28*a* opposed to each other with the terminal receiving chamber 19 interposed therebetween, are disposed generally diagonally with respect to the terminal receiving chamber 19.

Each terminal 11, inserted and fitted in the corresponding terminal receiving chamber 19, is held without shaking by diagonally-disposed surface portions of the terminal receiving chamber 19 where the wall reduction portions 31 are not formed. Therefore, in the connector 30 of this embodiment, the wall reduction portions 31 of a larger size can be formed in the respective partition walls 28*a* while ensuring that the terminals 11 can be positively held against shaking, and even with a smaller design of the connector, the impedance of the connector can be matched with the impedance of the cable 60.

Figure 7:
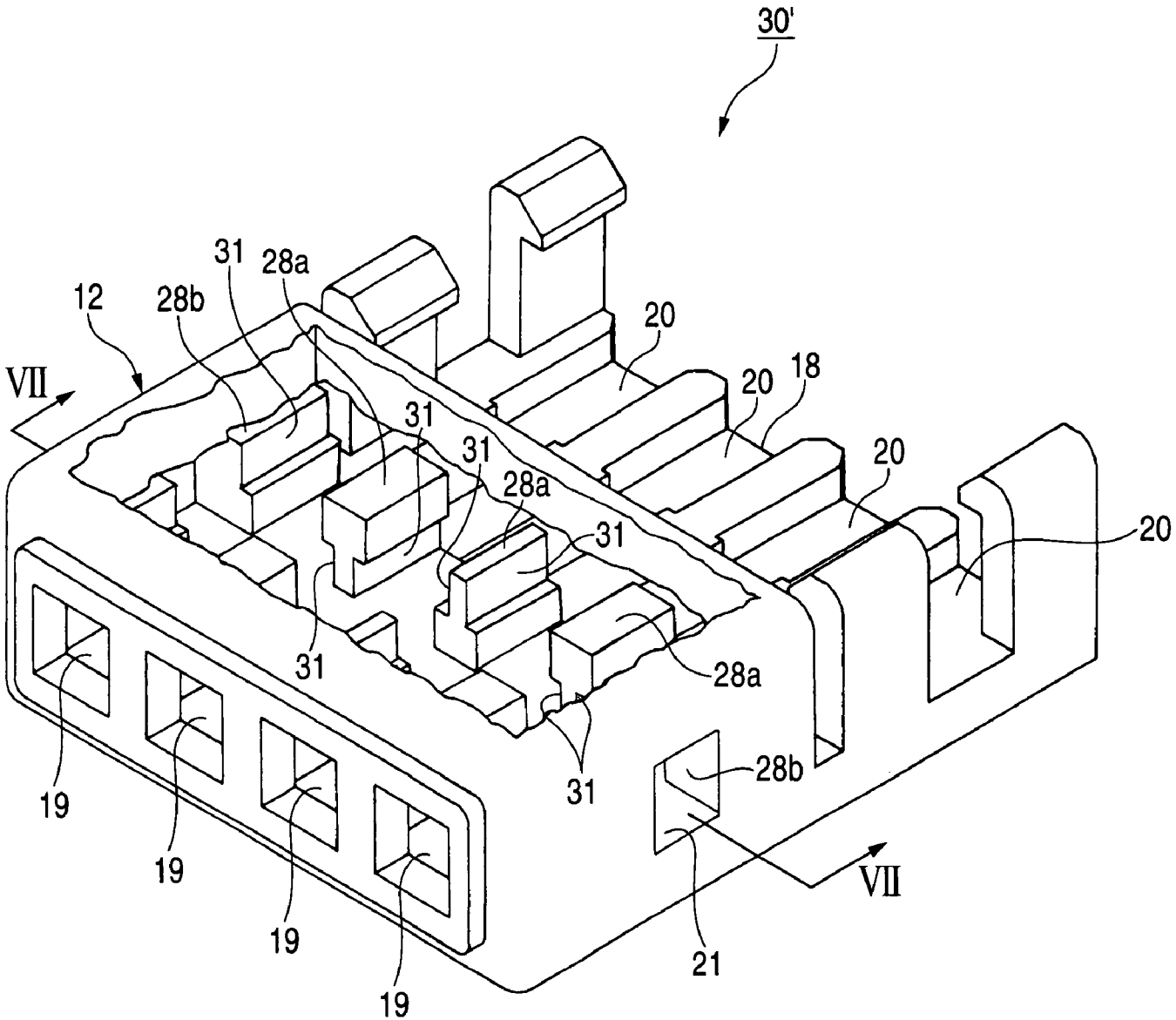
FIG. 7 is a partially-broken, perspective view of a modified example of the connector housing of FIG. 5.

Next, modified examples of the above connector 30 of the second embodiment will be described with reference to FIGS. 7 to 10. FIG. 7 is a partially-broken, perspective view of a modified example of the connector housing of FIG. 5, FIG. 8 is a cross-sectional view of the connector housing taken along the line VIII-VIII of FIG. 7, FIG. 9 is a perspective view of another modified example of the connector housing of FIG. 5, and FIG. 10 is a cross-sectional view taken along the line X-X of FIG. 9.

Figure 8:
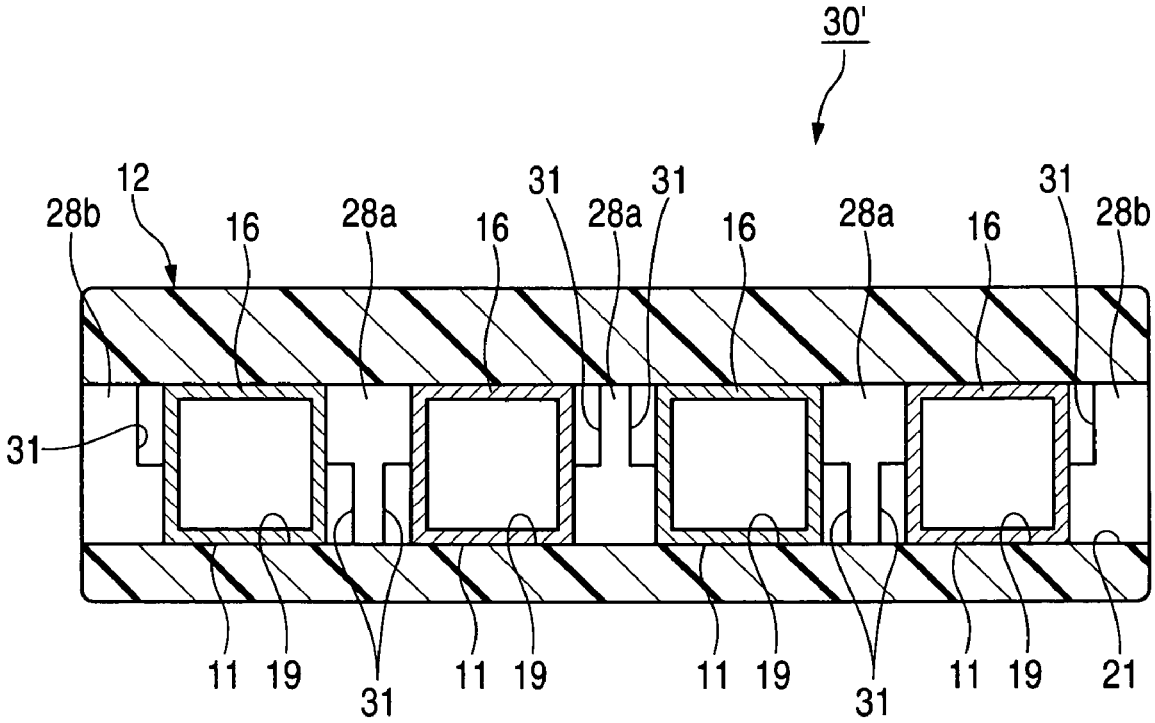
FIG. 8 is a cross-sectional view of the connector housing taken along the line VIII-VIII of FIG. 7.

In the connector 30' shown in FIGS. 7 and 8, the wall reduction portions 21 (formed respectively through the partition walls 28*a* and side walls 28*b* of the connector housing 12 of the above connector 10 of the first embodiment) are additionally provided at the connector housing 12 of the connector 30 of the second embodiment. In the connector 30' of this modified example, even with a smaller design of the connector, the impedance of the connector can be matched with the impedance of the cable 60.

Figure 9:
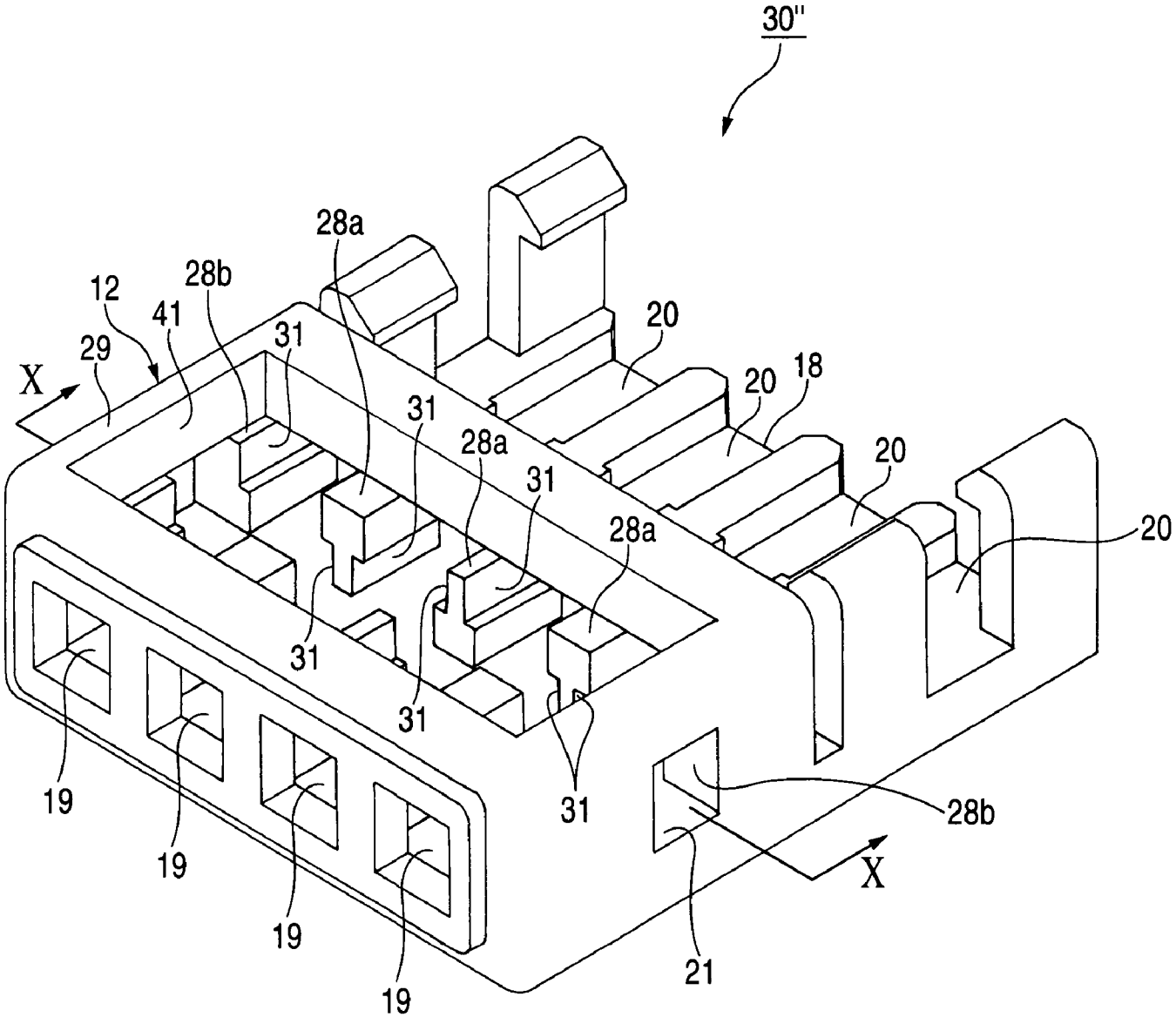
FIG. 9 is a perspective view of another modified example of the connector housing of FIG. 5.
Figure 10:
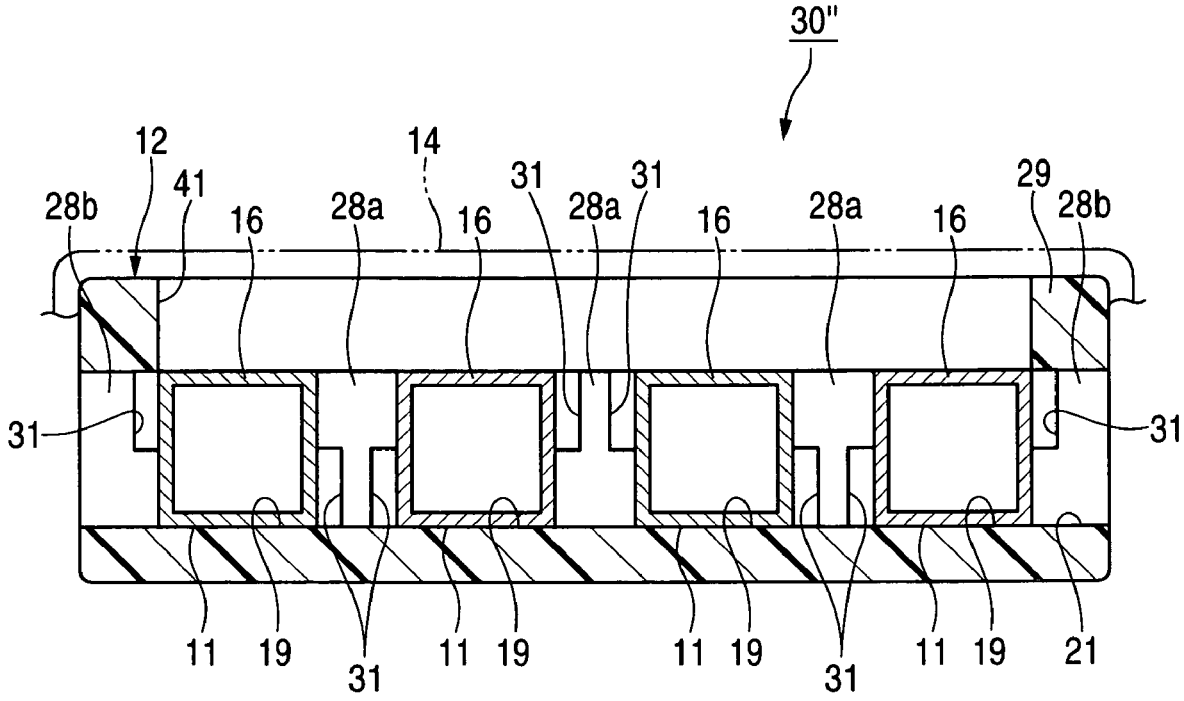
FIG. 10 is a cross-sectional view taken along the line X-X of FIG. 9.

The connector 30" shown in FIGS. 9 and 10 differs from the connector 30' (which is the modified example of the connector 30 of the second embodiment) in that a wall reduction portion 41 is formed through an upper wall 29 of the connector housing 12 (which is disposed between the row of terminals 11 and the shielding shell 14) in an upward-downward direction.

Particularly when the gap between the adjacent terminals 11 is small, the impedance of the connector 30" is predominantly determined by the gap between the adjacent terminals 11 (that is, the thickness of each partition wall 28*a*) and the dielectric constant of the partition walls 28*a*. However, when the gap between the row of terminals 11 and the shielding shell 14 is generally equal to the gap between the terminals 11, that is, the side walls 28*a*, upper wall 29 and bottom wall of the connector housing 12 are generally equal in thickness to the partition walls 28*a*, the thicknesses and dielectric constant of these side walls 28*b*, upper wall 29 and bottom wall are also related to the impedance of the connector 30".

Therefore, in the connector 30", the wall reduction portion 41 is also formed through the upper wall 29 of the connector housing 12, so that an air gap is formed between the row of terminals 11 and the shielding shell 14, and by doing so, the impedance of the connector 30", lowered by the reduced gap between the terminals, is increased so that the impedance of the connector can be matched with the impedance of the cable 60.

When the gap between the row of terminals 11 and the shielding shell 14 is smaller than the gap between the terminals 11, the impedance of the connector 30" is predominately determined by the thicknesses and dielectric constant of the side walls 28*b*, upper wall 29 and bottom wall of the connector housing 12, and therefore it is preferred to positively form wall reduction portions respectively in the side walls 28*b*, upper wall 29 and bottom wall of the connector housing 12 to thereby provide an air gap between the row of terminals 11 and the shielding shell 14.

The present invention is not limited to the above embodiments, and suitable modifications, improvements, etc., can be made.

What is claimed is:

1. A connector comprising:

a connector housing having a plurality of terminal receiving chambers arranged in a row; and a plurality of terminals which are connected respectively to end portions of a plurality of wires of a cable, and are received respectively in said terminal receiving chambers;

wherein a wall reduction portion is formed in partition walls of said connector housing interposed between adjacent ones of said terminal receiving chambers, whereby an impedance of said connector is matched with an impedance of said cable, wherein said wall reduction portion extends through said partition wall so as to form a hole in said partition wall between adjacent ones of said terminal receiving chambers.

2. A connector according to claim 1, wherein a plurality of said wall reduction portions are formed respectively through said partition walls in a direction of juxtaposition of said terminal receiving chambers, and to be aligned with one another in the direction of juxtaposition of said terminal receiving chambers.

3. A connector according to claim 1, wherein said connector is a differential transmission connector.

4. A connector according to claim 1, wherein said wall reduction portion further comprises a recess, that is formed in a side surface of said partition walls, respectively.

5. A connector according to claim 4, wherein each of said terminal receiving chambers has a generally rectangular cross-section; and each of said partition walls has said recess formed respectively in opposite side surfaces thereof, and said recesses, formed respectively in the side surfaces of any two adjacent partition walls opposed to each other with said terminal receiving chamber interposed therebetween, are disposed generally diagonally with respect to said terminal receiving chamber.

6. The connector according to claim 4, further comprising a hole formed through an upper wall of said connector housing.

* * * * *